US012690669B2

(12) United States Patent
Glöckl

(10) Patent No.: US 12,690,669 B2
(45) Date of Patent: Jul. 28, 2026

(54) HEIGHT-ADJUSTABLE MULTIFUNCTION TABLE

(71) Applicant: aeris GmbH, Haar bei Munich (DE)

(72) Inventor: Josef Glöckl, Kirchheim (DE)

(73) Assignee: aeris GmbH, Haar bei München (DE)

( * ) Notice: Subject to any disclaimer, the term of this patent is extended or adjusted under 35 U.S.C. 154(b) by 104 days.

(21) Appl. No.: 18/578,222

(22) PCT Filed: Jan. 25, 2022

(86) PCT No.: PCT/EP2022/051581
§ 371 (c)(1),
(2) Date: Jan. 10, 2024

(87) PCT Pub. No.: WO2023/006254
PCT Pub. Date: Feb. 2, 2023

(65) Prior Publication Data

US 2024/0298790 A1 Sep. 12, 2024

(30) Foreign Application Priority Data

Jul. 27, 2021 (DE) ..... 10 2021 119 418.0

(51) Int. Cl.
*A47B 21/02* (2006.01)
*A47B 13/08* (2006.01)

(52) U.S. Cl.
CPC ..... *A47B 21/02* (2013.01); *A47B 13/081* (2013.01); *A47B 13/088* (2013.01); *A47B 2200/0046* (2013.01); *A47B 2200/0062* (2013.01)

(58) Field of Classification Search
CPC ..... A47B 21/02; A47B 13/081; A47B 13/088; A47B 2200/0046; A47B 2200/0062; A47B 17/033

(Continued)

(56) References Cited

U.S. PATENT DOCUMENTS 3,338,647 A 8/1967 Schreyer
4,062,606 A * 12/1977 Peets ..... D05B 75/02 312/21

(Continued)

FOREIGN PATENT DOCUMENTS

CN 104605637 A 5/2015
CN 110638202 A 1/2020

(Continued)

OTHER PUBLICATIONS

International Search Report of the International Search Authority, issued in PCT/EP2022/051581, mailed May 2, 2022; ISA/EP.

(Continued)

*Primary Examiner* — Janet M Wilkens
(74) *Attorney, Agent, or Firm* — Harness, Dickey & Pierce, P.L.C.

(57) ABSTRACT

A height-adjustable table (1), such as an office table having a seated-working region and a standing-working region. The table (1) has two table tops (T1, T2), each having a left-hand and right-hand table side (LS1, RS1, LS2, RS2), a front table side (V) and a rear table side (R). As seen from the front table side (V), the table tops (T1, T2) are arranged one beside the other. The two table tops (T1, T2) are arranged at two different working heights (A1, A2), in order to form the respective seated-working region and standing-working region. The two table tops (T1, T2) are fastened at a variable distance apart from one another in the height direction H. The higher-level table top (T1) forms a table surface (TF1) which, as seen in the height direction, is arranged very much predominantly to almost completely alongside the table surface of the lower table top (T2).

12 Claims, 7 Drawing Sheets

(58) Field of Classification Search
USPC ..... 108/20, 92, 64, 65; 312/194, 111, 198, 312/205, 233.3, 317.3, 107, 195, 196
See application file for complete search history.

(56) References Cited

U.S. PATENT DOCUMENTS

| | | | | | |
|---|---|---|---|---|---|
| 4,449,762 | A * | 5/1984 | Turner | A47B 81/06 108/92 |
| 5,160,104 | A * | 11/1992 | Sher | A47B 81/064 248/176.1 |
| 5,443,017 | A * | 8/1995 | Wacker | A47B 17/02 108/5 |
| 5,947,569 | A * | 9/1999 | Rheault | A47B 83/001 312/317.3 |
| 2017/0354244 | A1 | 12/2017 | Lee et al. | |
| 2017/0360190 | A1* | 12/2017 | Chen | A47B 21/02 |

FOREIGN PATENT DOCUMENTS

| | | | | |
|---|---|---|---|---|
| DE | 7427139 | U | 12/1974 | |
| DE | 9202675 | U1 | 4/1992 | |
| DE | 19814948 | A1 | 10/1999 | |
| DE | 19814948 | C2 * | 3/2001 | A47B 9/14 |
| DE | 10033216 | A1 | 1/2002 | |
| DE | 202004000859 | U1 * | 4/2004 | A47B 37/00 |
| DE | 20 2012 008 753 | U1 | 10/2012 | |
| DE | 20 2014 008 346 | U1 | 11/2014 | |
| DE | 10102484 | B4 | 2/2015 | |
| DE | 10 2014 015 407 | A1 | 4/2016 | |
| DE | 102016103433 | A1 | 8/2017 | |
| DE | 10 2018 106 989 | A1 | 9/2018 | |
| DE | 10 2019 130 840 | A1 | 5/2021 | |

OTHER PUBLICATIONS

European Office Action dated Nov. 21, 2025 in corresponding European Application No. 22702232.4.
Chinese Office Action dated Mar. 9, 2026 in corresponding Chinese Application No. 202280041920.
Chinese Search Report dated Mar. 5, 2026 in corresponding Chinese Application No. 202280041920.0.

* cited by examiner

HEIGHT-ADJUSTABLE MULTIFUNCTION TABLE

CROSS-REFERENCE TO RELATED APPLICATIONS

This application is a 371 U.S. National Phase of International Application No. PCT/EP2022/051581, filed Jan. 25, 2022, which claims priority to German Application No. 10 2021 119 418.0 filed Jul. 27, 2021. The entire disclosures of the above applications are incorporated herein by reference.

DESCRIPTION

The invention relates to a height-adjustable multifunction table, in particular an office work table, for use when seated and when standing.

Different embodiments of height-adjustable tables are known in the prior art.

With widely used tables and office workstations known in the prior art, the user is generally limited to a workstation with a table, which results in a predominantly sedentary activity.

Presently, known tables and height-adjustable tables are designed as individual functional units which are independent of one another and which the users can arrange in their desired arrangement. Therefore, conventional offices are organized such that, if possible, all work equipment, such as telephone, keyboard, mouse, screen and working tools, are within reach. Such tables often also have a mobile pedestal in which additional work equipment is available to the user within reach. There are even REFA studies, recording times down to tenths of a second, as to how time-saving handling of work equipment and peripherals, including printers and the removal of printed materials, can be realized.

The idea behind this concept is that every tenth of a second of time saved when accessing documents and work equipment quickly increases performance and efficiency. This is true for machines, but not for the people who are supposed to work at such workstations.

With humans, physiological and psychological factors and properties determine their performance and efficiency. The increase in damage to health that can be traced back to sedentary office work is reflected in the increasing number of pathologies affecting people who do office work. More and more people suffer from so-called diseases of affluence caused by constant and hour-long rigid sitting in the office.

In the field of office chairs, so-called active dynamic seating arrangements have already been developed to enable the chair user to sit actively.

However, there is still the problem that the user or, for example, the office worker, rarely moves away from their chair and, as such, nevertheless causes a predominantly sedentary activity. Meanwhile, there have been a number of findings which speak in favor of alternating between seated and standing activities, thus promoting active behavior in the office.

In recent decades, office workstations have been set up according to technical and economic, sometimes also according to aesthetic aspects. Considerations on designing the working environment of people according to the needs of their genetic makeup and their physiological peculiarities are new and little known so far. A disadvantage of the prior art is the fact that there are no furniture systems suitable for the user, which are technically designed to be suitable for the activity in the office. Not every kind of movement is principally good for people, and one movement does not equal the other. What matters is the quality and extent of movement, as demonstrated by the latest scientific evidence.

DE 10033216 A1 discloses table systems for, in addition to height adjustment, also easily modify the dimensions of the working surface without auxiliary means. Such adjustments and modifications do not require tools, so that the table according to the invention is easily and quickly adaptable to a wide variety of applications. In addition to height adjustment, the particular advantage is the modification of the width of the working surface. However, this height-adjustable table with a variable table top consists of multiple basic elements and is thus not set up easily also when space is limited. Further, there is a need to change from the seated position to the standing position and vice versa more frequently without major adaptation and modification measures.

DE 10102484 B4 discloses a height-adjustable table, in particular a seated-standing workstation, having at least two telescopic table legs, the synchronization and weight compensation of which are accomplished by means of a synchronizing cable drive, consisting of two synchronizing cables guided in opposite directions in a crosswise manner, which are guided by means of dual return pulleys to the ends of the telescopic table legs, wherein the synchronizing cable drive is directly associated with at least one cable drive in a non-positive manner, each having a drive shaft, and wherein one or also both synchronizing cables are each wound around a drive shaft at least once or in accordance with the required force transmission, and then continue synchronization.

There are a number of other adjustment devices to adjust the height of a table using a motor, via gas pressure springs or by means of transmission systems.

Such systems are complex in structure and require a comparatively long time for reconfiguring positions to be able to change from working while seated to a standing position.

However, the present invention not only concerns basic variability and adjustability of a work table, in particular of an office work table, but also a solution for space-optimized realization of the active office concept. The core of the concept is a table arrangement known under the Active Office Desk® brand, namely a unique working surface combination consisting of a standing and a sitting workstation, which are connected to one another via an angular foot. The standing height and the sitting height are each electrically height-adjustable and thus individually adaptable to the special needs of the operator and user. Thus, the user has the possibility to switch back and forth between the standing- and seated-working surfaces on either a task or time basis. The resulting work dynamics can be integrated into the workflow without any problems. Because of the fact that each table can be suitably adjusted in height according to a person's body dimensions. Such tables are known from DE 102016103433 A1, which also stems from the present applicant of this invention. In this way, a standing and seated workstation can be created next to one another, between which a user can change back and forth. However, there is not enough space in many offices, especially smaller ones, to set up such arrangements. As such, there is a need for a space-saving arrangement and solution to be able to realize an "active office concept" even with less space available.

In this respect, a particular problem is that people have different leg lengths and body sizes. For example, there are not only small people with short legs, but also with long legs and, for example, a short upper body. Similarly, there are tall people, who may have long legs and a short upper body. Due to the large number of possible dimensions of leg length, upper body length and overall body size, it is difficult to provide a height-adjustable table which is equally easy to operate. Workplace analysis has shown that height-adjustable tables are not regularly adjusted, for example every 10 or 15 minutes, but only quite sporadically. However, the "active office concept" only shows its effect if the positional changes are made frequently and regularly throughout the day.

Therefore, it is an object of the invention to overcome the aforementioned disadvantages and to realize a space-saving table concept to be able to carry out active working and, in particular, rapid changing from a seated position into the standing position and vice versa, while no disturbing table consoles should be in the way. Further, an intelligent smart technology is to be provided, which facilitates various intelligent functions for a table user.

This object is achieved by the combination of features according to the specification, drawings and claims.

According to the invention, for this purpose, a table, in particular an office table or workstation table, is suggested, having a seated-working region and a standing-working region, wherein the table has two table tops (T1, T2), which each have a left-hand and right-hand table side, a front table side and a rear table side, wherein, as seen from the front table side, the table tops are arranged one beside the other, wherein the two table tops are arranged at two different working heights, in order to form the respective seated-working region and standing-working region, wherein the two table tops are fastened at a fixed or variable distance apart from one another in the height direction H, and wherein the higher-level table top forms a table surface which, as seen in the height direction, is arranged almost completely alongside the table surface of the lower table top.

Height adjustment and height configuration can be done in different ways:

- It may be provided that either the upper or the lower table top has a fixed height and the respective other table top is height-adjustable;
- It may be provided that both table tops are height-adjustable synchronously;
- It may be provided that both table tops are separate and thus individually height-adjustable.

These variants are not described separately below, but each represent an alternative constellation in relation to the specific description.

The selected distance between the upper side of the lower table top and the upper side of the upper table top is advantageously in the range between 27-39 cm, preferably in the range between 31-36 cm. A distance of 33 cm is particularly advantageous, as here, the reference can be adapted to the average body size.

As a result of this novel solution, the user has a working surface available for seated and standing activities at the same time at a single table, while the upper side of the lower table top typically lies in the range of about 74 cm from the floor, while, at said distance of 33 cm from the second table top, the upper working surface is arranged at a height of about 107 cm.

Thus, persons, i.e., users, who are larger than the assumed average person, need to move the upper table top somewhat upwards when changing positions and rather smaller persons need to lower the upper table top somewhat or move it downwards. However, according to the invention, it is not necessary to move the table top up and down about 30 to 40 cm each time, as in the solutions known in the prior art, but only in a range of about +/−3 to 7 cm or even less.

It is advantageously provided that the table only has table legs on or in the region of the left-hand table side of the first table top and the right-hand table side of the second table top, and the two table tops are connected to one another at or in a region of the respective other table side (in the middle in the respective central position) by a vertical suspension cross member. It is particularly advantageous if the relative height of the two table tops relative to one another is also adjustable.

This can be achieved by the vertical suspension cross member having a height adjustment device with an adjustment range for adjusting the relative distance of the two table tops relative to one another, as seen in the height direction. Furthermore, it is advantageously provided that the lower table top is guided at the height adjustment device by a bearing means, which is preferably mounted on or near the table side edge of the lower table top.

In a likewise advantageous embodiment of the invention, it is provided that the table has exactly one table leg each at or in the region of the left-hand table side of the first table top and the right-hand table side of the second table top, and accordingly each table top is supported on the floor via only one table leg which is located substantially at the sides of the table. This ensures that no disturbing parts are located underneath the table. In order to produce a stable construction, it may be provided for a horizontal cross strut to extend at the lower end of the table legs.

Therefore, in a further advantageous embodiment of the invention, it is provided that no table leg is present in a central region of the table, in particular in an overlapping region of the two table tops.

For the purposes of the present invention, a table leg is a support leg which extends down to the floor and has the function of supporting the table top vertically with respect to a supporting surface.

For the purposes of the present invention, a suspension cross member is a substantially vertical cross member with a holding function, no portion of which touches the floor, but which rather constitutes a connecting bracket between the upper and lower table tops. According to the invention, the table is designed such that it looks as though both table tops were, so to speak, "freely floating in space" in the central table region.

In a further advantageous embodiment of the invention, it is provided that the upper table top is arranged above the lower table top with only one lateral table top portion, projecting beyond less than 25% of the table top surface of the lower table top.

With the concept of the invention, the user can quickly and conveniently change from a seated to a standing activity and back, and vice versa. Even with a still required small height adjustment of, for example, 3 cm for a user, the user does not get the feeling of having to wait long for the table position to be adjusted, but can continue work immediately. If, for example, a user of small body size only desires a standing working height of 100 cm, they can set a height correction factor of −7 cm, and then only this height adjustment is necessary. With a conventional height-adjustable table, the table top would have to be adjusted by about 25-30 cm each time.

Accordingly, in an advantageous embodiment of the invention, a height adjustment device may be provided which requires a travel of a maximum of 14 cm. It has been shown that the vast majority of users are able to manage a height adaptation of about +/−3 cm.

It is advantageous if the two table tops have the same basic shape and are aligned so as to be mirror-inverted relative to one another or are located in a symmetrical arrangement.

A further likewise preferred embodiment of the invention provides that the table tops each have a rear edge on the rear table side, which extends at an angle of about 90° to the respective outer lateral table side edges, while the front table edge on the respective front table side extends predominantly at an oblique angle, preferably at an angle of between 35° and 55°, relative to the respective outer table side edge.

In the figures.

In the following, the invention is explained in more detail with reference to FIGS. 1 to 7, the same reference numerals in the figures indicating the same functional and/or structural features.

The figures show exemplary embodiments of tables according to the invention, namely office tables 1. The tables 1 each have a supporting frame 2, with two table legs 10, 20, each having a vertically adjustable column, at the top end of which a cross member is provided for supporting the table top T1, T2.

The height-adjustable table 1 has the two table tops T1, T2, each forming left-hand and right-hand table sides LS1, RS1, LS2, RS2, as well as a front table side V and a rear table side R. The arrangement of the upper and lower table tops T1, T2 may also be exactly the opposite.

The two table tops T1, T2 are arranged at two different working heights A1, A2 for forming the respective seated- and standing-working region, wherein the two table tops T1, T2 are fastened to one another at a fixed or variable distance in the height direction H. The lower table top T2 defines a seated-working region (in these embodiments, the right-hand table top as seen from the front) and a standing-working region through the left table top T1.

Figure 7:
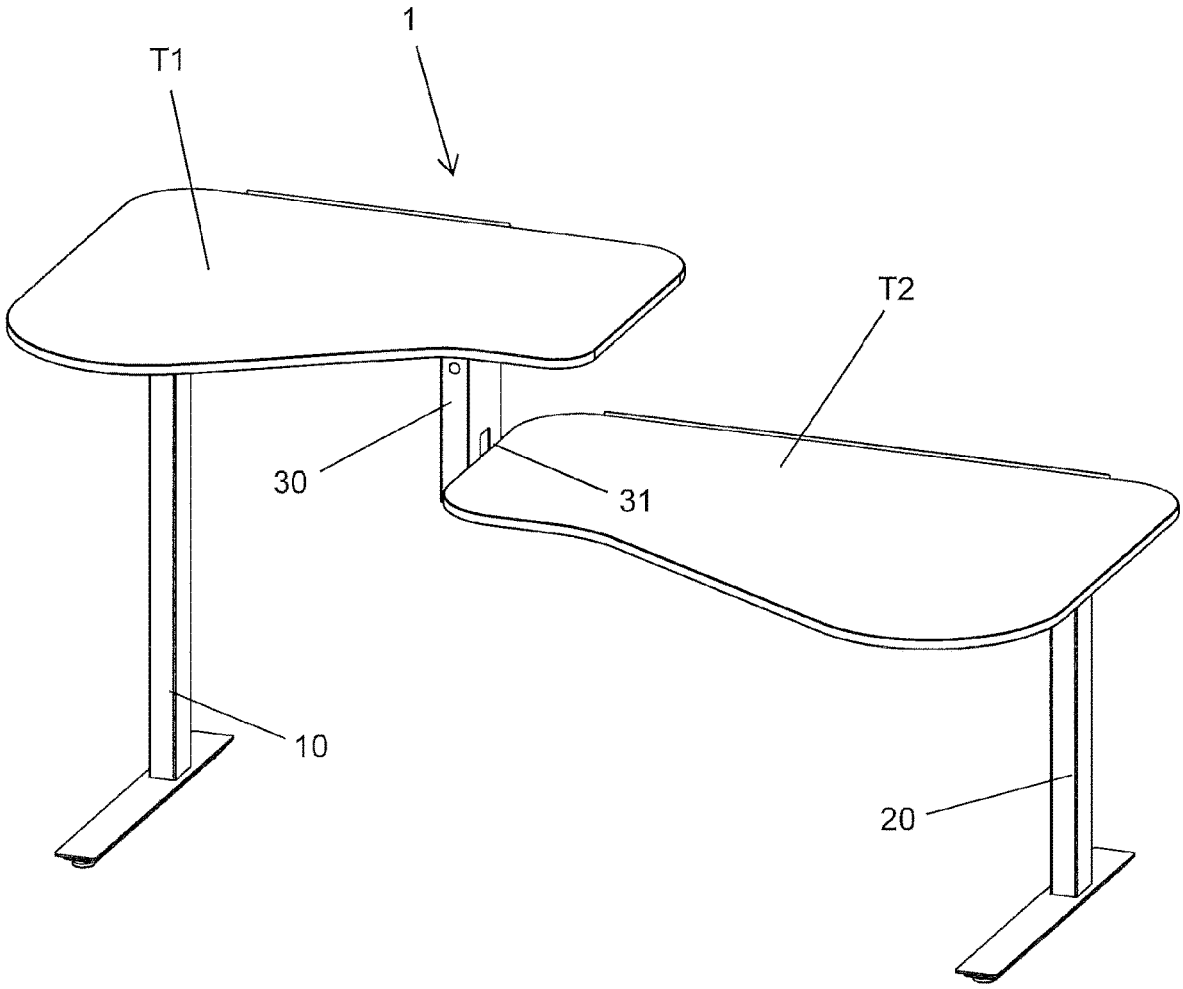
FIG. 7 shows a further perspective front view of an exemplary embodiment of the present invention.

The supporting frame 2, which is height-adjustable in the height direction H, is operable for synchronous or also separate height adjustment of the two table tops T1, T2 fastened to the supporting frame 2 at different working planes A1, A2. On the one hand, the vertical suspension cross member 30 connects the two table tops for static reasons and, as can be seen FIG. 7, further has a height adjustment device 31 with an adjustment range for adjusting the relative distance of the two table tops T1, T2 from one another, as seen in the height direction. The lower table top T2 is guided on the height adjustment device 31 by a corresponding bearing means 32.

In this embodiment, the two table tops can either be raised or lowered synchronously with respect to the two table legs 10, 20, or the lower table top T2 can be adjusted in height with respect to the upper table top T1. However, the latter function can also be omitted if the table user accepts that certain height adaptations may be necessary in the event of a change of position.

For example, the table tops T1, T2 may be fastened to the supporting frame at a fixed distance of 33 cm relative to one another in the height direction H, wherein the upper table top T1, as seen in the height direction, is arranged above, but substantially outside of (or, in the projection direction, next to) the working surface of the lower table top T2.

Each table top T1, T2 is supported on exactly one table leg 10, 20 each, which is attached to or in the region of the left-hand table side LS1 for the upper table top T1 and to or in the region of the right-hand table side RS2 for the lower table top T2.

In a central region of the table 1, there is an overlapping region of the two table tops T1, T2, where only the suspension cross member 30 is attached, but no table leg is present.

Figure 1:
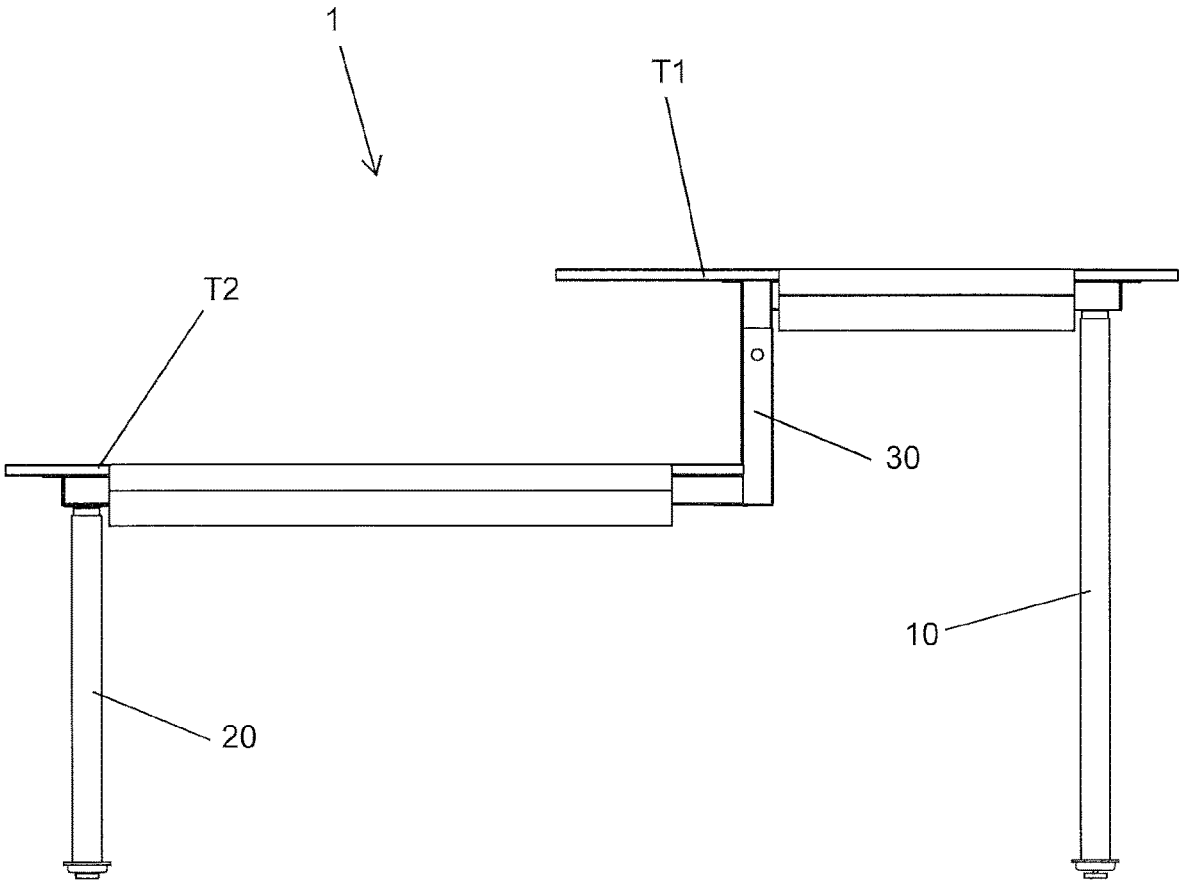
FIG. 1 shows a rear view of a first exemplary embodiment of the present invention.
Figure 2:
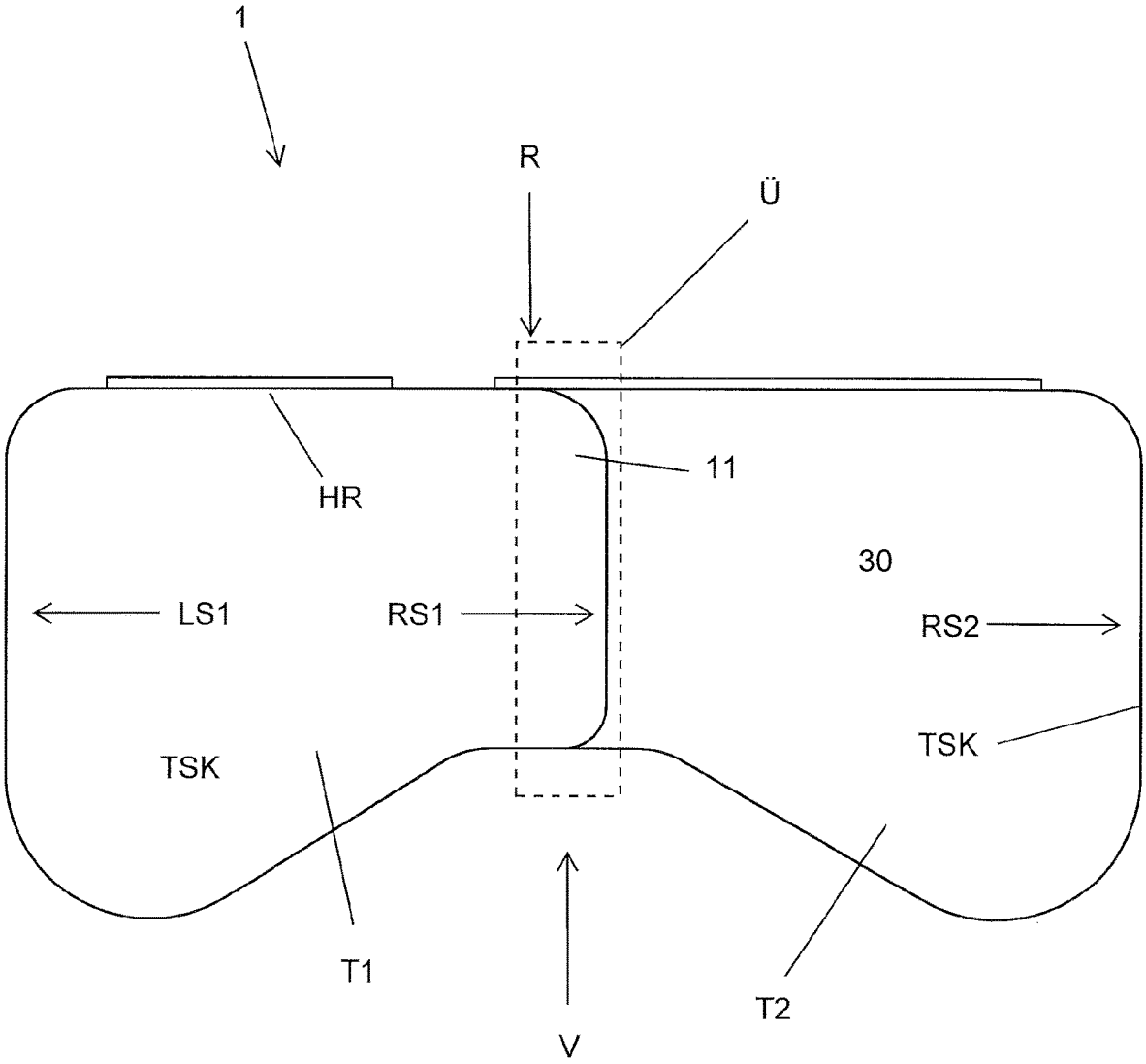
FIG. 2 shows a top view of the table of FIG. 1.
Figure 3:
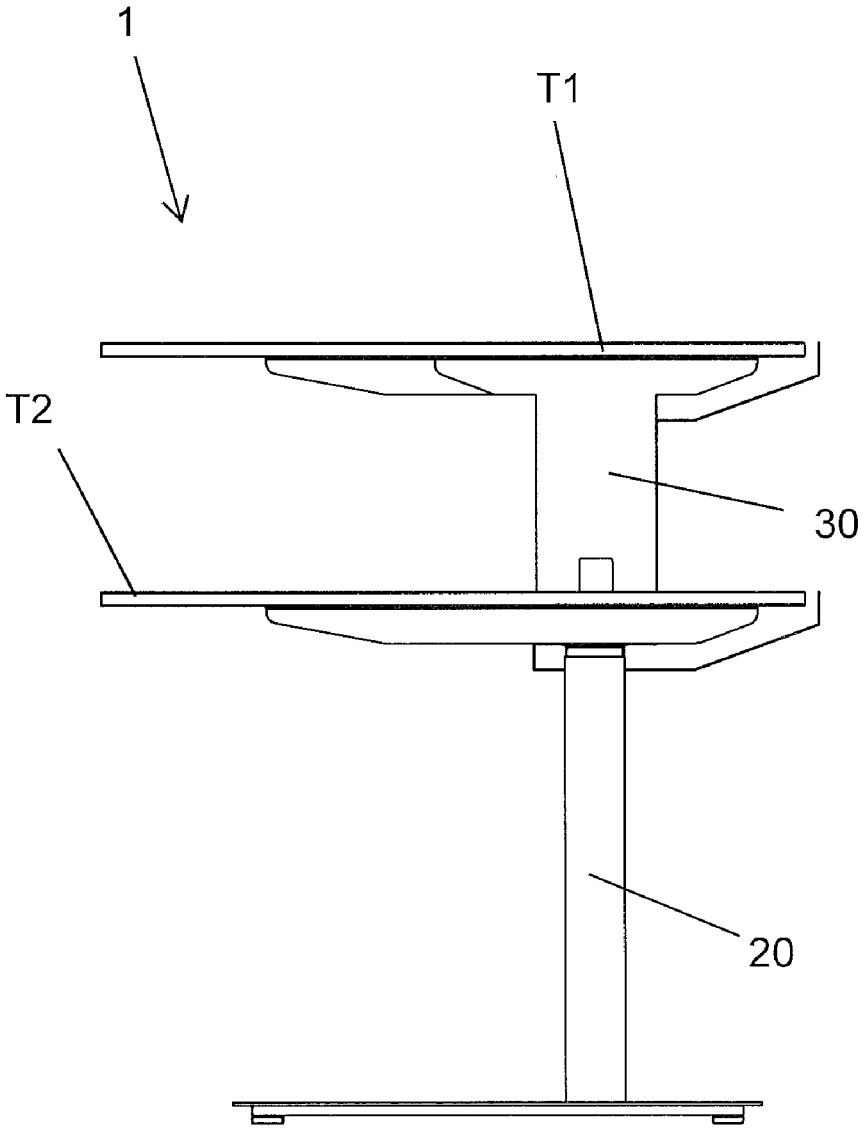
FIG. 3 shows a side view from the right onto the table of FIG. 1.
Figure 4:
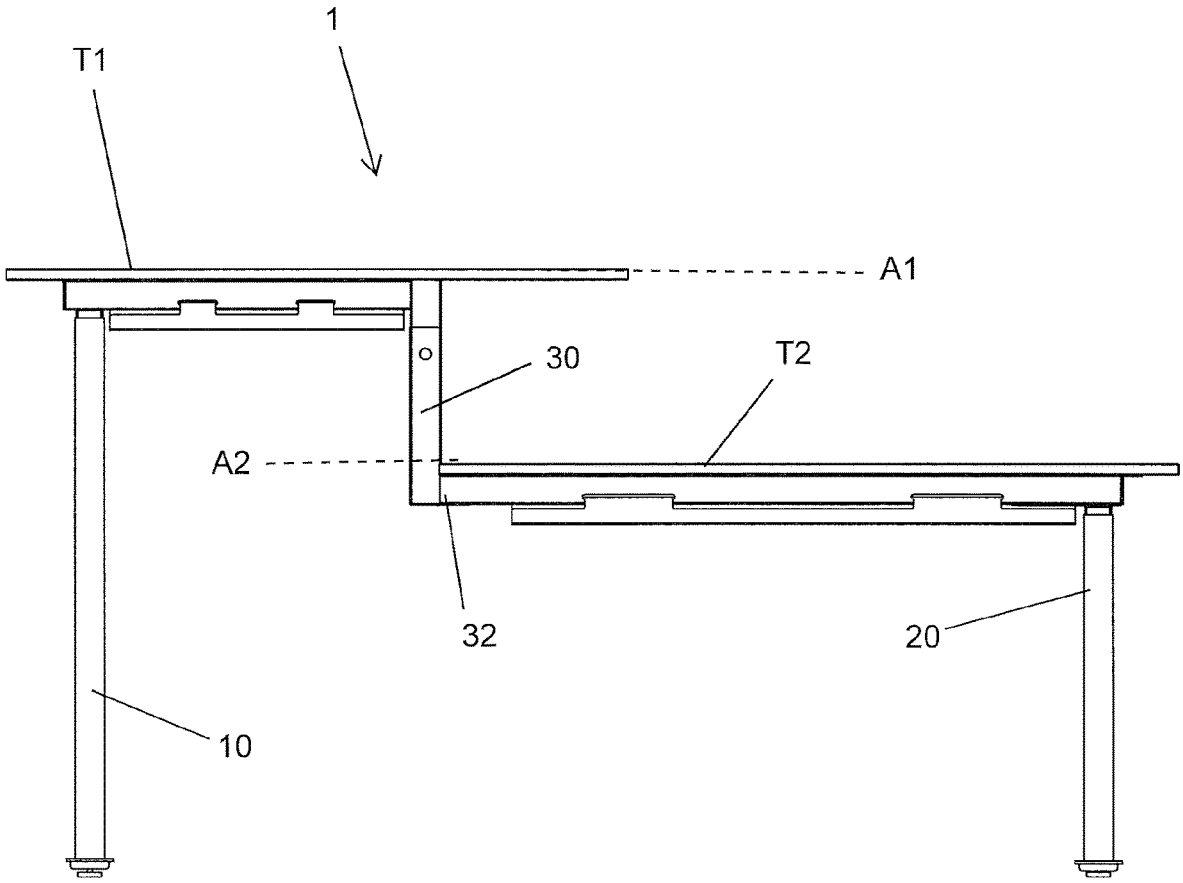
FIG. 4 shows a front view onto the table of FIG. 1.
Figure 5:
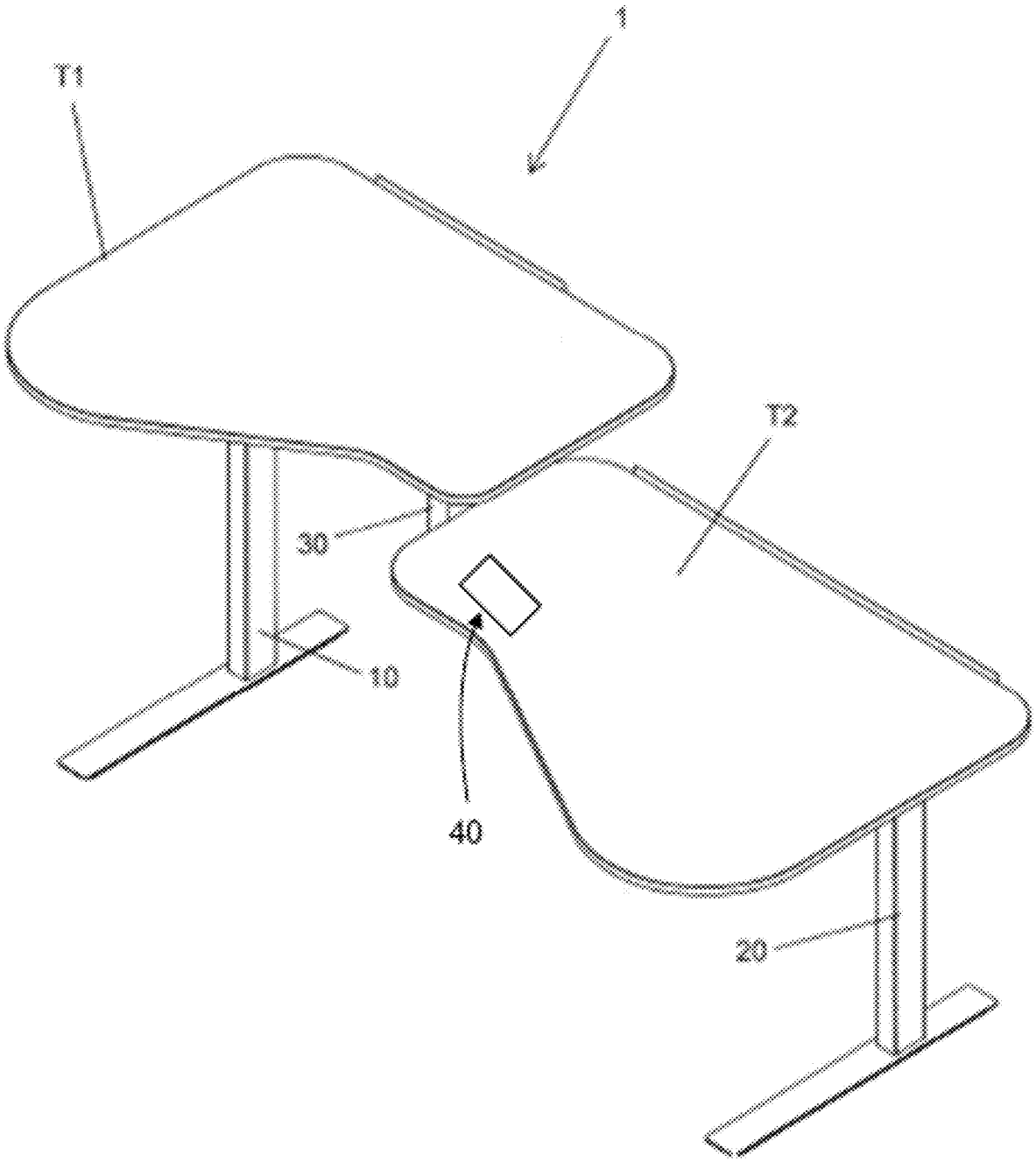
FIG. 5 shows a perspective view onto the table of FIG. 1.
Figure 6:
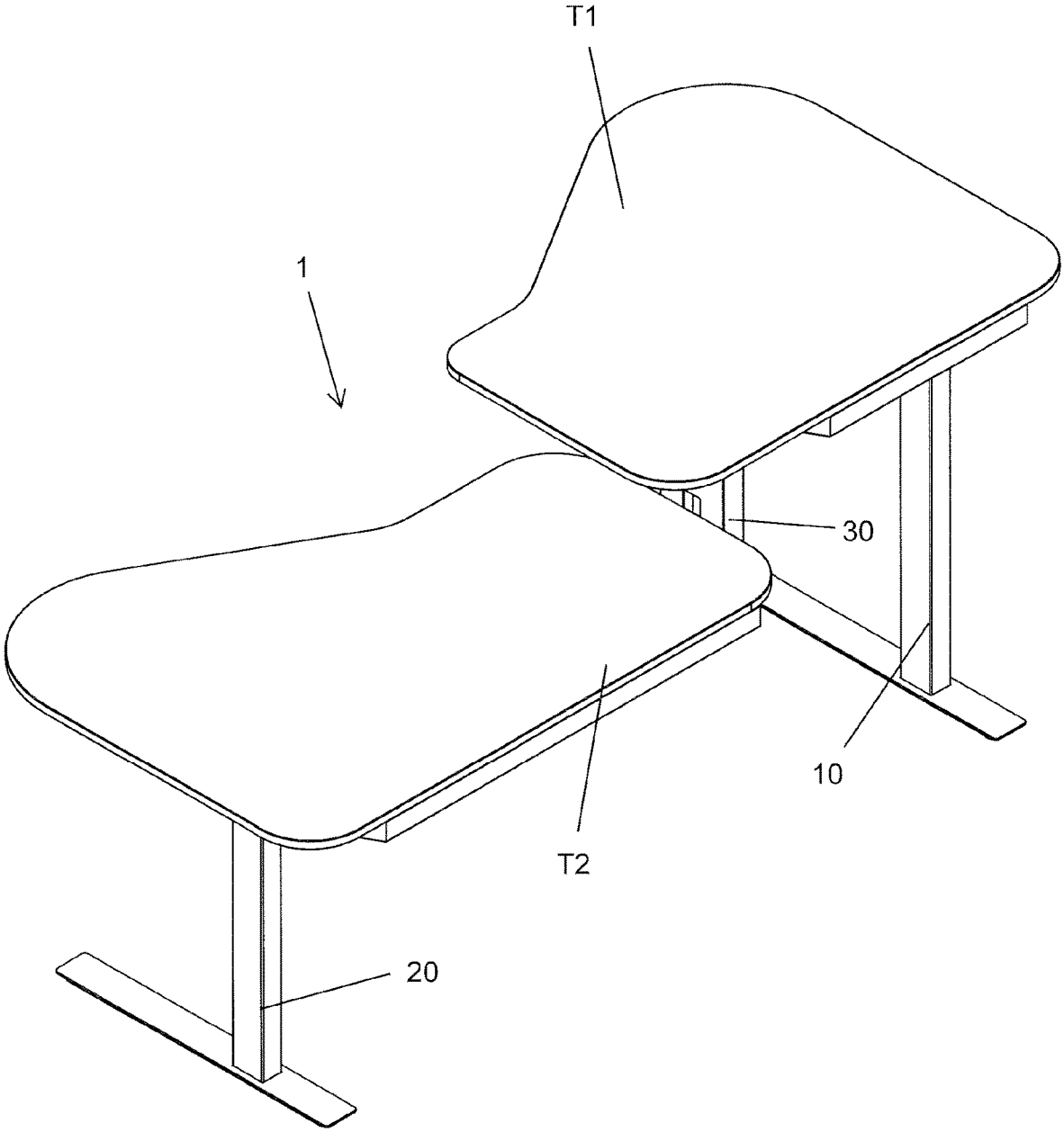
FIG. 6 shows a perspective rear view.

In the top view of FIG. 2, it can be seen clearly that the table tops T1, T2 each have a rear edge HR on the rear table side R, which extends at an angle of about 90° to the respective outer lateral table side edges TSK, while the front table edge VK on the respective front table side V extends predominantly at an oblique angle, preferably at an angle of between 35° and 55°, relative to the respective outer table side edge TSK. The table corners are configured to be rounded.

A control device 40 which registers whether an identified (via a user interface) user is in the seated or standing position at the table. The controller device 40 stores personal data for this user. In particular, with regard to one or more body dimensions (such as leg length, body size, upper body length, etc.), the control device 40 performs an automatic height adaptation, via the height adjustment device 31, depending on the seated or standing position.

If the height of the lower table top is to be variable as well, it is possible to realize a further height adjustment range for the lower table top, by additionally configuring the device to be height-adjustable by about 30-40 cm via a telescope.

Thus, the intelligent table control 40 may also instruct the user to change from the seated position to the standing position and vice versa at regular time intervals. This may be displayed via a display device or via an interface on a smartphone. For this purpose, a docking station or an interface thereto may be integrated into the table. Further, data lines and supply lines may also be integrated in or on the table tops.

A method for setting up and adapting the height of the table tops of the table is configured with the control device 40 for automatic or user-activated synchronous or separate adjustment of the height of the table tops of the table 1. As described above, it changes from a seated to a standing position and/or vice versa for an individual user. The method comprises:

a. entering user-specific data, in particular body data, such as body size, leg length, upper body length of a user;
b. adjusting a target height of the upper table top for the user, which corresponds to a desired height for working in the standing position;
c. adjusting a target height of the lower table top for the user, which corresponds to a desired height for working in the seated position;
d. automatically modifying the height in the direction of the target height of the upper table top when changing from the seated position of a table user to the standing position as soon as the current height of the upper table top does not correspond to the target height of the upper table top.

Other advantageous developments of the invention are characterized in the dependent claims or are presented in detail below along with the description of the preferred embodiment of the invention with reference to the figures.

The practice of the invention is not limited to the preferred exemplary embodiments set forth above. Instead, a number of variants may be contemplated which make use of the solution shown even in case of basically different embodiments.

The invention claimed is:

1. A height-adjustable table, an office table, comprising a seated-working region and an adjacent standing-working region;

the table has two table tops, each with a left-hand and right-hand table side, a front table side and a rear table side, wherein, as seen from the front table side, the table tops are arranged one beside the other;

the two table tops are arranged at two different working heights, in order to form the respective seated-working region and standing-working region;

the two table tops are fastened at a variable distance apart from one another in the height direction H, and the higher-level table top forms a table surface which, as seen in the height direction, is arranged very much predominantly to almost completely alongside or outside of the table surface of the lower table top; and the table only has table legs at or in the region of the left-hand table side of the first table top and the right-hand table side of the second table top, and the two table tops are connected to one another at or in a region of the respective other table sides by a vertical suspension cross member.

2. The table according to claim 1, wherein the table has exactly one table leg at or in the region of the left-hand table side of the first table top and the right-hand table side of the second table top, and accordingly each table top is only supported on the floor by one table leg.

3. The table according to claim 1, wherein no table leg is present in a central region of the table, in an overlapping region of the two table tops.

4. The table according to claim 1, wherein the upper table top is arranged above the lower table top with only one lateral table top portion in an overlapping region, projecting beyond less than 25% of the table top surface of the lower table top.

5. The table according to claim 1, wherein the table tops have a same basic shape and are aligned so as to be mirror-inverted relative to one another.

6. The table according to claim 1, wherein the table tops each have a rear edge on the rear table side, that extends at an angle of about 90° to the respective outer lateral table side edges, while the front table edge on the respective front table side extends predominantly at an oblique angle, at an angle of between 35° and 55°, relative to the respective outer table side edge.

7. The table according to claim 1, wherein the distance of the upper side of the lower table top to the lower side of the upper table top is in the range of between 27-39 cm.

8. The table according to claim 1, further comprising an intelligent table control and a sensor system, which, in addition to the height adjustment, allows to automatically detect whether a table user is present in a defined region in front of the standing-working region, thus the upper table top, or a defined region in front of the seated-working area, thus in front of the lower table top.

9. The table according to claim 1, wherein the vertical suspension cross member has a height adjustment device with an adjustment range for adjusting the relative distance of the two table tops from one another, as seen in the height direction.

10. The table according to claim 9, wherein the lower table top is guided on the height adjustment device by a corresponding bearing means.

11. The table according to claim 1, wherein a control device is provided that registers whether an identified user is in the seated or standing position at the table and, as a function of personal data stored for this user, with regard to one or more body dimensions, the control device performs an automatic height adaptation in the range of −7 cm to +7 cm, depending on the seated or standing position.

12. A method for setting and adapting the height of one or both table tops of a table, configured with a control system for automatic or user-activated adjustment of the height of the table tops of a table according to claim 1, when changing from a seated to a standing position and/or vice versa for an individual user, having the following steps:

a. entering user-specific data, in particular body data, body size, leg length, upper body length of a user;

b. adjusting a target height of the upper table top for the user, that corresponds to a desired height for working in the standing position;

c. adjusting a target height of the lower table top for the user, that corresponds to a desired height for working in the seated position; and d. automatically modifying the height in the direction of the target height of the upper table top when changing from the seated position of a table user to the standing position as soon as the current height of the upper table top does not correspond to the target height of the upper table top.

* * * * *